US010992084B2

(12) United States Patent
Su et al.

(10) Patent No.: US 10,992,084 B2
(45) Date of Patent: Apr. 27, 2021

(54) ELECTRICAL CONNECTOR HAVING SEPARATE FRONT INSULATIVE SHELL AND REAR METALLIC SHELL

(71) Applicants: FUYU ELECTRONICAL TECHNOLOGY (HUAIAN) CO., LTD., Huai'an (CN); FOXCONN INTERCONNECT TECHNOLOGY LIMITED, Grand Cayman (KY)

(72) Inventors: Jie Su, Huaian (CN); Jun Zhao, Huaian (CN)

(73) Assignees: FUYU ELECTRONICAL TECHNOLOGY (HUAIAN) CO., LTD., Huai'an (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/556,167

(22) Filed: Aug. 29, 2019

(65) Prior Publication Data

US 2020/0076134 A1 Mar. 5, 2020

(30) Foreign Application Priority Data

Aug. 30, 2018 (CN) ..... 201821418624.5

(51) Int. Cl.
*H01R 13/6582* (2011.01)
*H01R 12/58* (2011.01)
(Continued)

(52) U.S. Cl.
CPC ..... *H01R 13/6582* (2013.01); *H01R 12/58* (2013.01); *H01R 12/724* (2013.01); *H01R 13/405* (2013.01); *H01R 13/502* (2013.01); *H01R 13/5219* (2013.01); *H01R 13/6594* (2013.01); *H01R 24/60* (2013.01); *H01R 2107/00* (2013.01)

(58) Field of Classification Search
CPC ..... H01R 13/6594; H01R 13/6582; H01R 13/405; H01R 13/502; H01R 24/60; H01R 13/5219; H01R 12/724; H01R 12/58; H01R 2107/00
See application file for complete search history.

(56) References Cited

U.S. PATENT DOCUMENTS 6,702,616 B1 * 3/2004 Chang ..... H01R 13/6273 439/607.23
8,801,463 B2 * 8/2014 Tan ..... H01R 13/521 439/607.04

(Continued)

FOREIGN PATENT DOCUMENTS

CN 105449398 A 3/2016
CN 206471608 U 9/2017

*Primary Examiner* — Briggitte R. Hammond
(74) *Attorney, Agent, or Firm* — Ming Chieh Chang; Wei Te Chung

(57) ABSTRACT

An electrical connector includes: a housing having a base, a front tongue, and a rear mount; an upper and lower rows of contacts arranged in the housing and exposed respectively to two opposite surfaces of the tongue; an insulative shell mounted to the base and including a pair of mounting lugs, each mounting lug having a hole; and a metallic shell shielding the rear mount, wherein the metallic shell has a pair of securing arms fastened to the pair of mounting lugs.

13 Claims, 11 Drawing Sheets

(51) Int. Cl.

| | |
|---|---|
| ***H01R 12/72*** | (2011.01) |
| ***H01R 13/502*** | (2006.01) |
| ***H01R 13/6594*** | (2011.01) |
| ***H01R 13/405*** | (2006.01) |
| ***H01R 24/60*** | (2011.01) |
| ***H01R 13/52*** | (2006.01) |
| ***H01R 107/00*** | (2006.01) |

(56) References Cited

U.S. PATENT DOCUMENTS

| | | | | |
|---|---|---|---|---|
| 9,331,421 | B2 * | 5/2016 | Lai | H01R 13/405 |
| 9,425,560 | B1 * | 8/2016 | Su | H01R 13/506 |
| 9,496,665 | B2 * | 11/2016 | Do | H01R 24/62 |
| 9,525,241 | B1 * | 12/2016 | Su | H01R 13/6582 |
| 9,761,988 | B1 * | 9/2017 | Lin | H01R 13/5216 |
| 9,954,303 | B2 * | 4/2018 | Guo | H01R 13/6585 |
| 10,177,488 | B2 * | 1/2019 | Zhao | H01R 24/20 |
| 2009/0280694 | A1 * | 11/2009 | Zhuang | H01R 24/64 439/668 |
| 2016/0006195 | A1 * | 1/2016 | Zhao | H01R 13/504 439/676 |
| 2016/0043500 | A1 * | 2/2016 | Mori | H01R 43/24 439/271 |
| 2017/0331235 | A1 | 11/2017 | Yokoyama et al. | |
| 2018/0138642 | A1 * | 5/2018 | Kong | H01R 13/652 |
| 2018/0159266 | A1 | 6/2018 | Yu et al. | |

* cited by examiner

ELECTRICAL CONNECTOR HAVING SEPARATE FRONT INSULATIVE SHELL AND REAR METALLIC SHELL

BACKGROUND OF THE INVENTION

1. Field of the Invention

The present invention relates to an electrical connector including a terminal module, a front insulative shell having a pair of mounting lugs, and a rear metallic shielding shell, wherein the rear metallic shielding shell is fastened to the front insulative shell.

2. Description of Related Arts

WO 2016/080010 discloses an electrical connector including a contact module, a shielding shell enclosing the contact module, and a rear shielding plate securely fixed to an insulative housing of the contact module or welded externally to the shielding shell.

China Patent No. 105449398 discloses an electrical connector including a terminal module and an insulative shield enclosing the terminal module.

SUMMARY OF THE INVENTION

An electrical connector comprises: a housing having a base, a front tongue, and a rear mount; an upper and lower rows of contacts arranged in the housing and exposed respectively to two opposite surfaces of the tongue; an insulative shell mounted to the base and including a pair of mounting lugs, each mounting lug having a hole; and a metallic shell shielding the rear mount, wherein the metallic shell has a pair of securing arms fastened to the pair of mounting lugs.

DETAILED DESCRIPTION OF THE PREFERRED EMBODIMENTS

Figure 1:
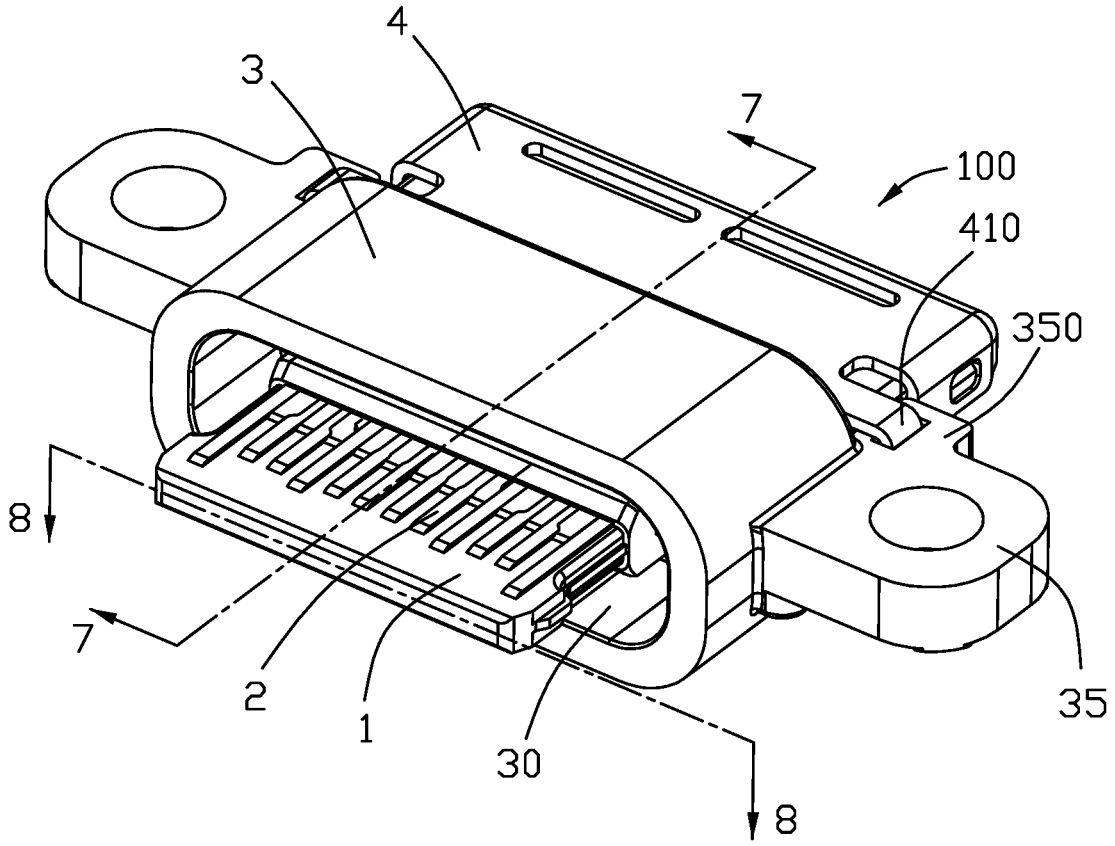
FIG. 1 is a front perspective view of an electrical connector in accordance with the present invention.
Figure 2:
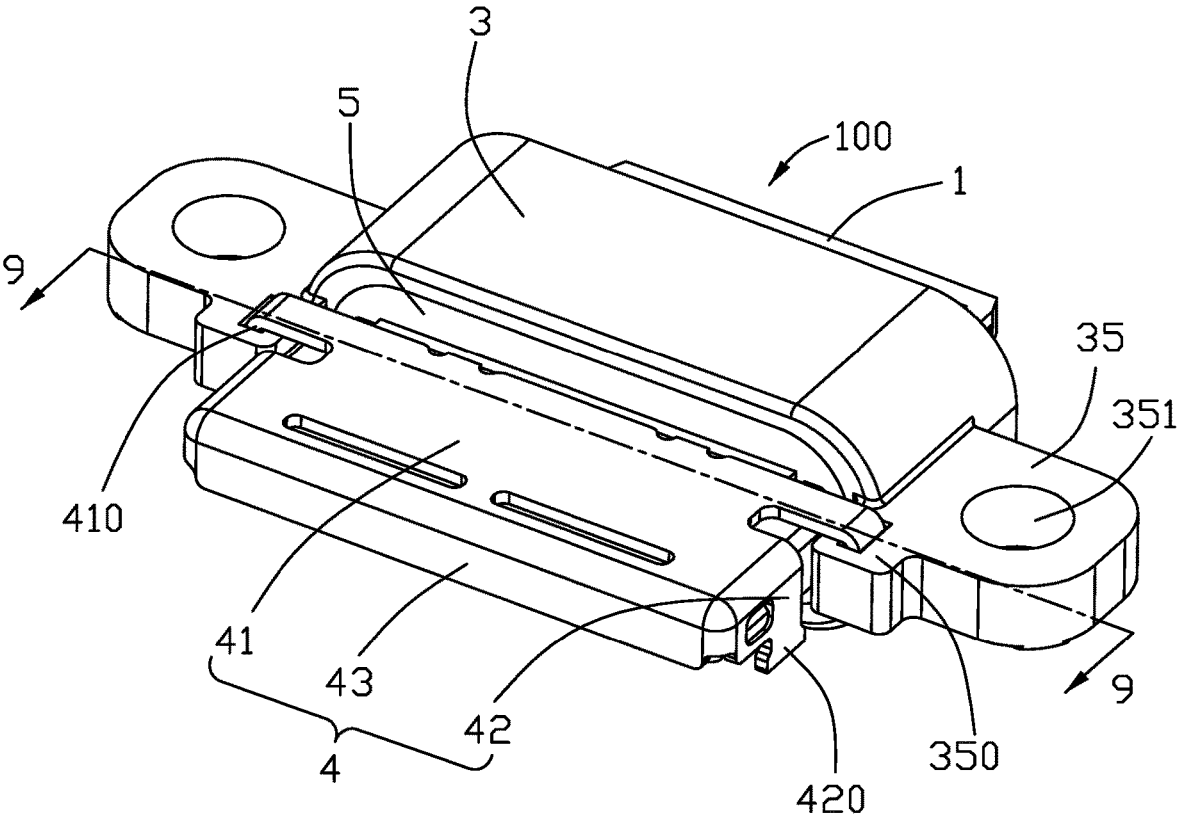
FIG. 2 is a rear perspective view of the electrical connector.
Figure 3:
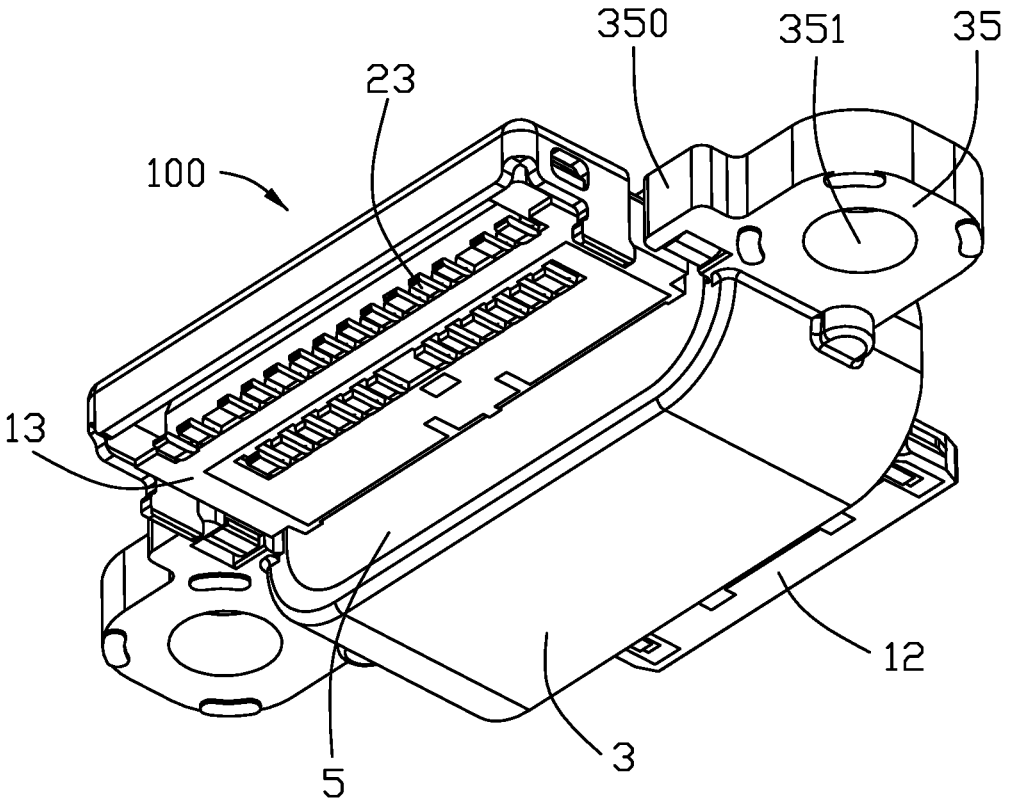
FIG. 3 is a bottom rear perspective view of the electrical connector.
Figure 4:
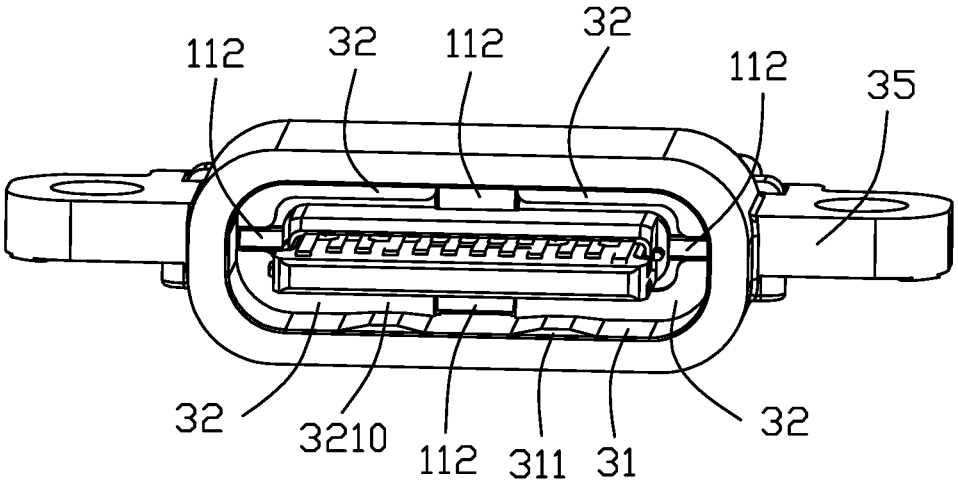
FIG. 4 is another front perspective view of the electrical connector.
Figure 5:
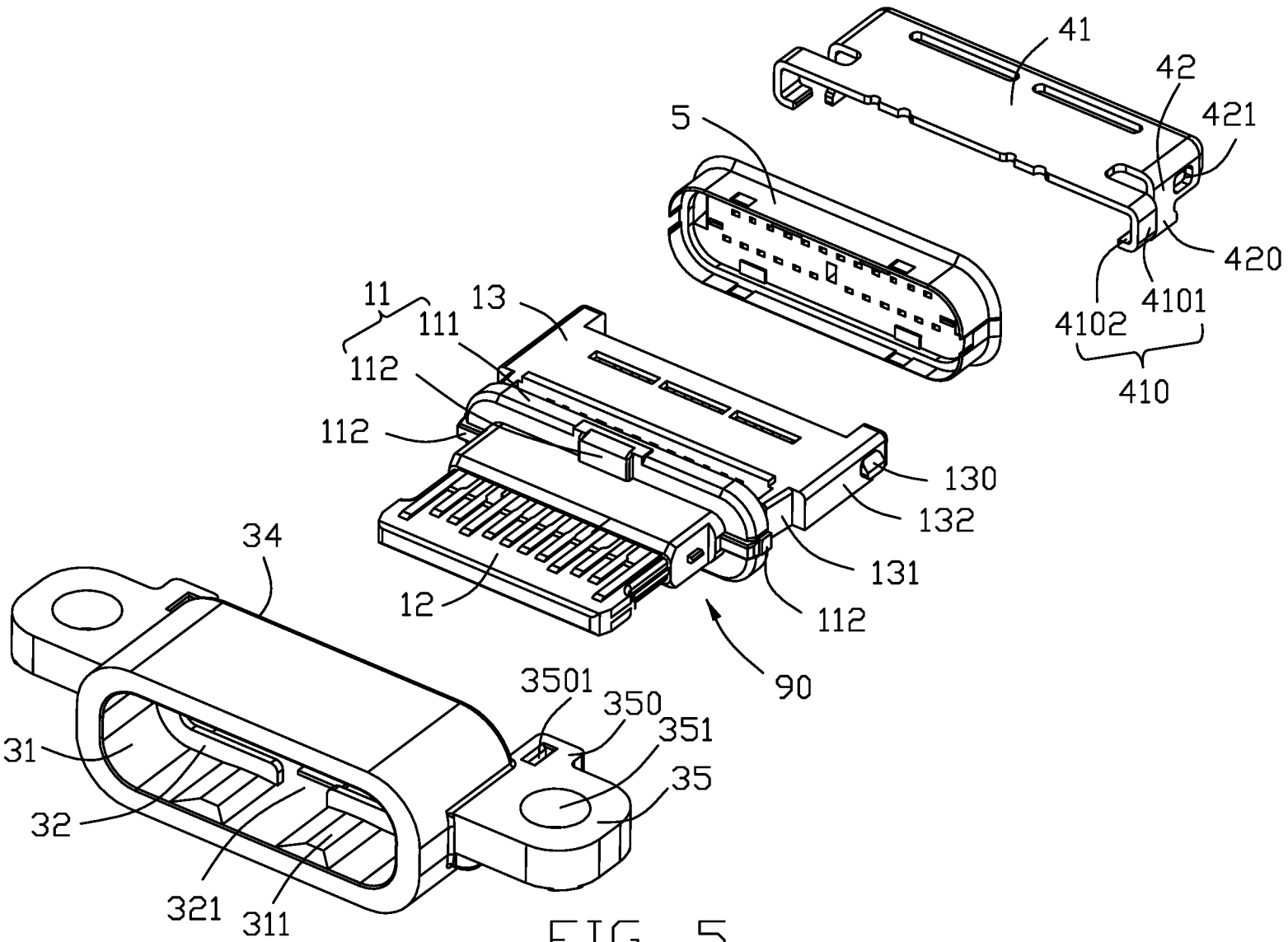
FIG. 5 is an exploded view of the electrical connector in FIG. 1.
Figure 6:
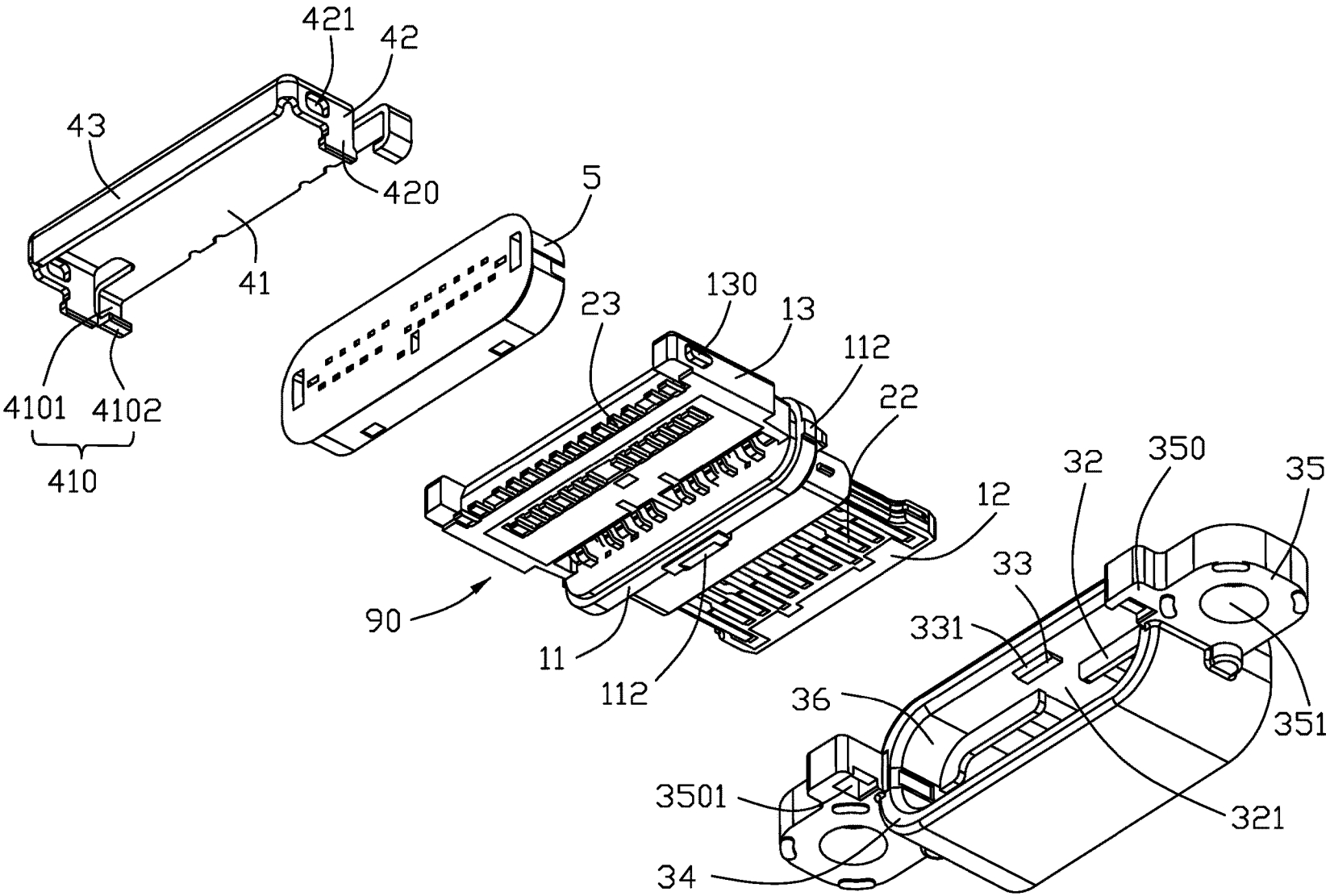
FIG. 6 is an exploded view of the electrical connector in FIG. 3.

Referring to FIGS. 1-11, an electrical connector 100 comprises an insulative housing 1, a plurality of contacts 2 of upper and lower rows arranged in the insulative housing 1, an insulative shell 3 mounted to the insulative housing 1, and a metallic shell 4 shielding the insulative housing 1. The electrical connector 100 may further comprise a waterproof sealing member 5 sealed between the insulative housing 1 and the insulative shell 3.

Figure 10:
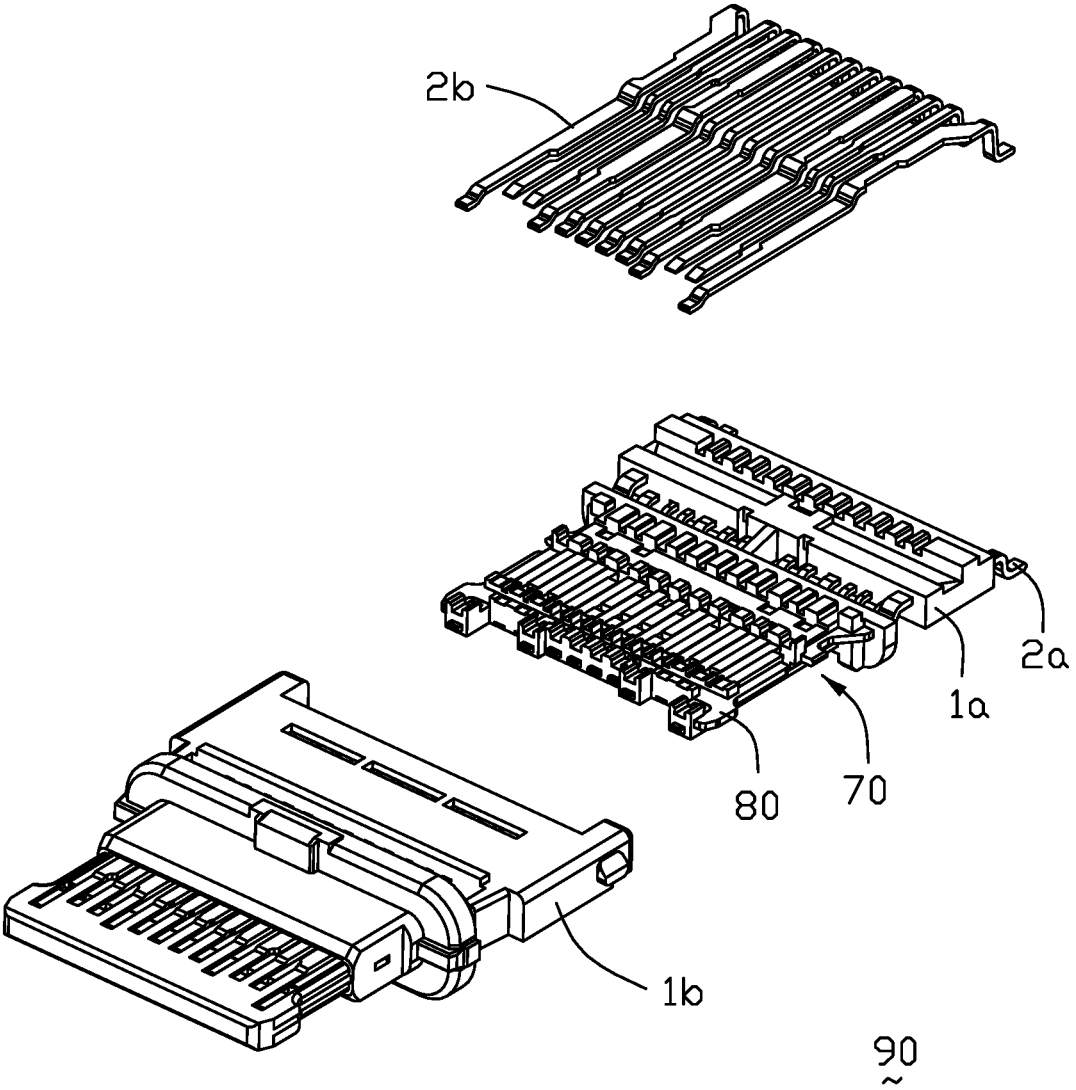
FIG. 10 is an exploded perspective view of the contact module of the electrical connector of FIG. 5.
Figure 11:
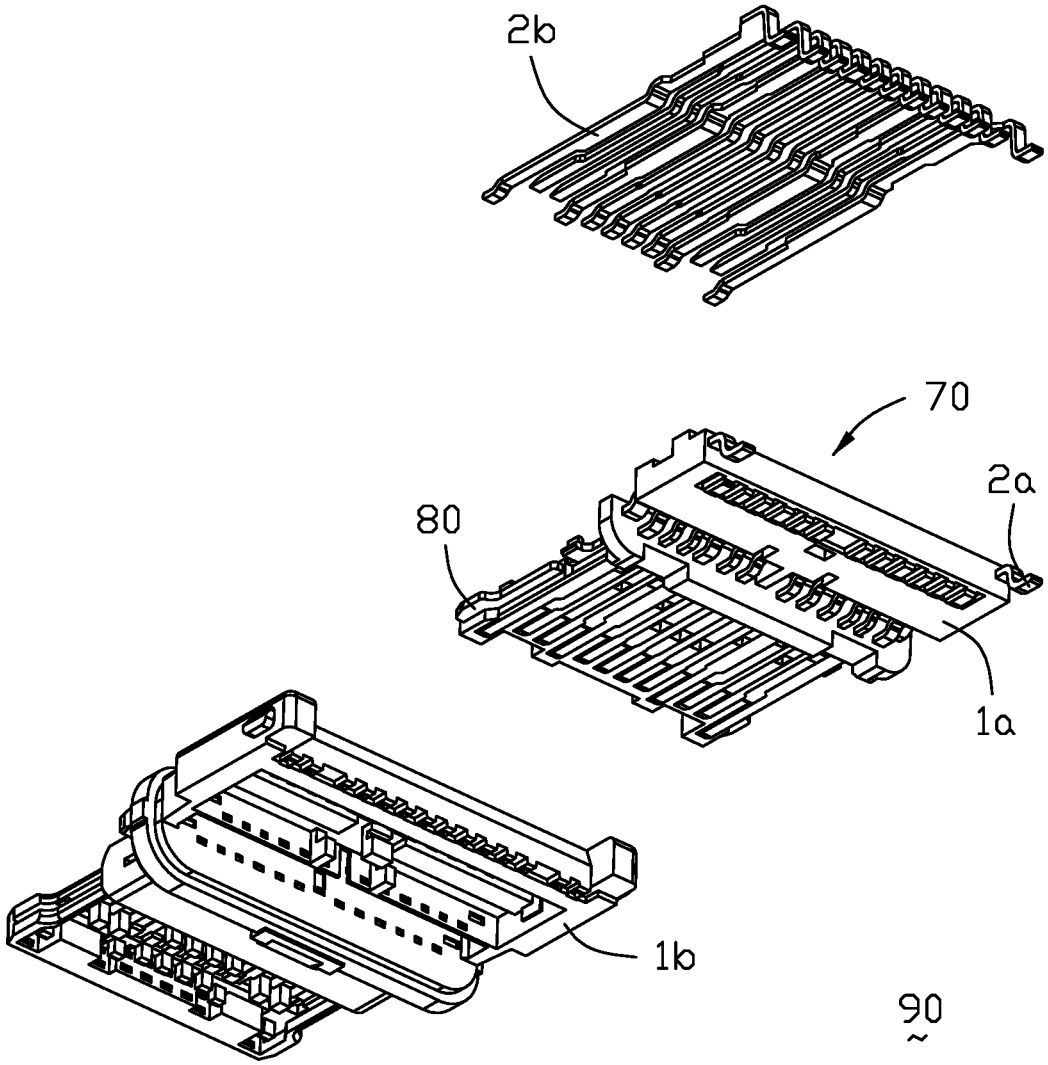
FIG. 11 is an exploded perspective view of the contact module of the electrical connector of FIG. 6.

The housing 1 includes a base 11, a front tongue 12, and a rear mount 13. The contact 2 has a securing portion 21 secured to the base 11, a contacting portion 22 exposed to a surface of the tongue 12, and a soldering portion 23 extending out of the rear mount 13. In detail, as shown in FIGS. 10 and 11, the housing 1 and the contacts 2 are essentially formed as the contact module 90 wherein the metallic shielding plate 80 and the lower row contacts 2*a* are firstly integrally formed with a first insulator 18 to form a preliminary contact module 70 via a first stage insert-molding process, and the upper row contacts 2*b* are then put upon the upper side of the preliminary contact module 70 and integrally formed with a second insulator 19 to form the complete contact module 90. Notably, the lower row contacts 2*a* and the shielding plate 80 are embedded within the first insulator 18 while the upper row contacts 2*b* are embedded within the second insulator 19. Understandably, the first insulator 18 and the second insulator 19 commonly form the housing 1.

The insulative shell 3 encloses the tongue 12 to form a mating space 30. The metallic shell 4 shields the rear mount 13 and therefore the contacts 2. In detail, the insulative shell 3 includes opposite top wall and bottom wall and opposite two side walls to commonly form a receiving cavity in which the housing 1 is received.

The insulative shell 3 of a tubular main body (not labeled), has a stop wall 32 protruding from an interior wall 31 thereof and plural openings 321 are formed at the stop wall 32. The base 11 has a main body 111 and plural protruding blocks 112 for engaging the stop wall 32 and the openings 321, respectively. Preferably, four blocks 112 are provided at top and bottom, left and right, respectively; correspondingly, the stop wall 32 has four openings 321. A front face 3210 of the stop wall 32 is located forwardly of the blocks 112 of the base 11, preferably for about 0.05 mm, so that an inserted complementary connector will abut the stop wall 32, not pressing on the base 11. The interior wall 31 of the insulative shell 3 has protruding ribs 311 for engaging an inserted complementary connector.

Figure 7:
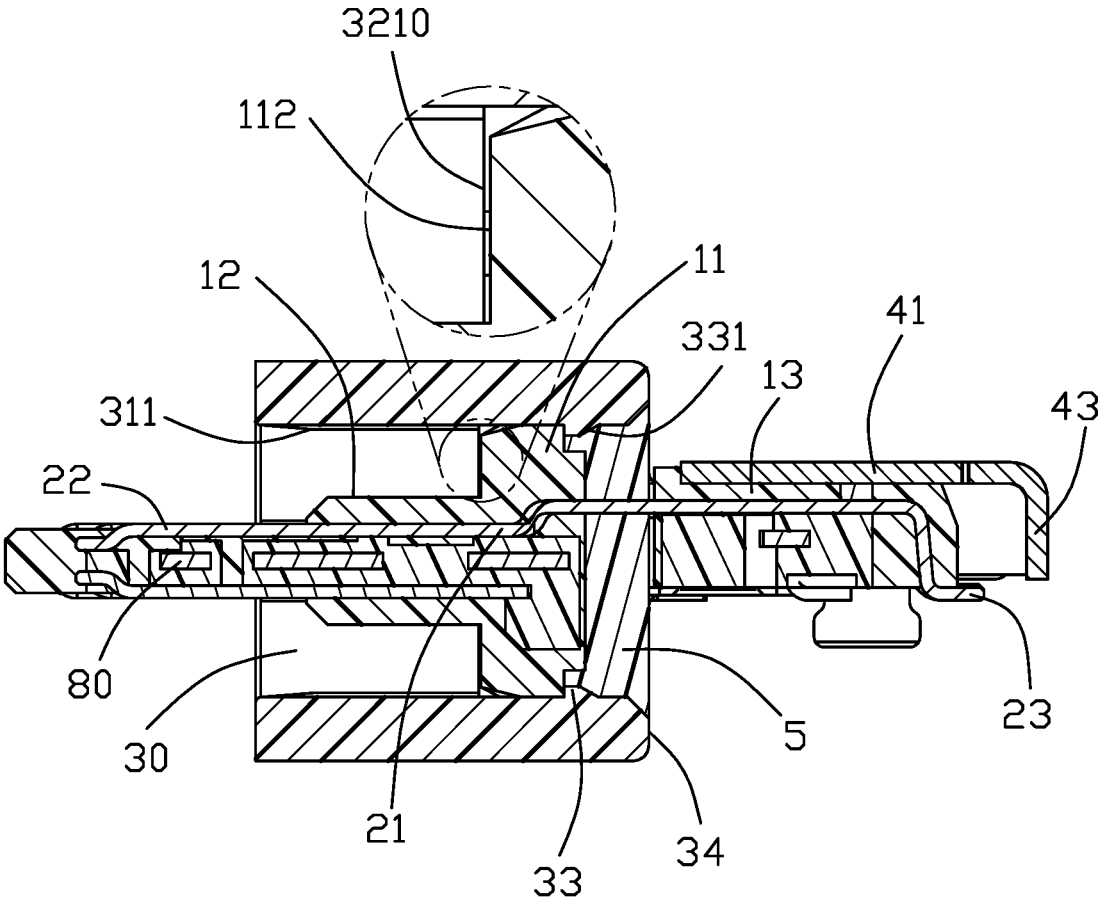
FIG. 7 is a cross-sectional view of the electrical connector taken along line A-A in FIG. 1.
Figure 8:
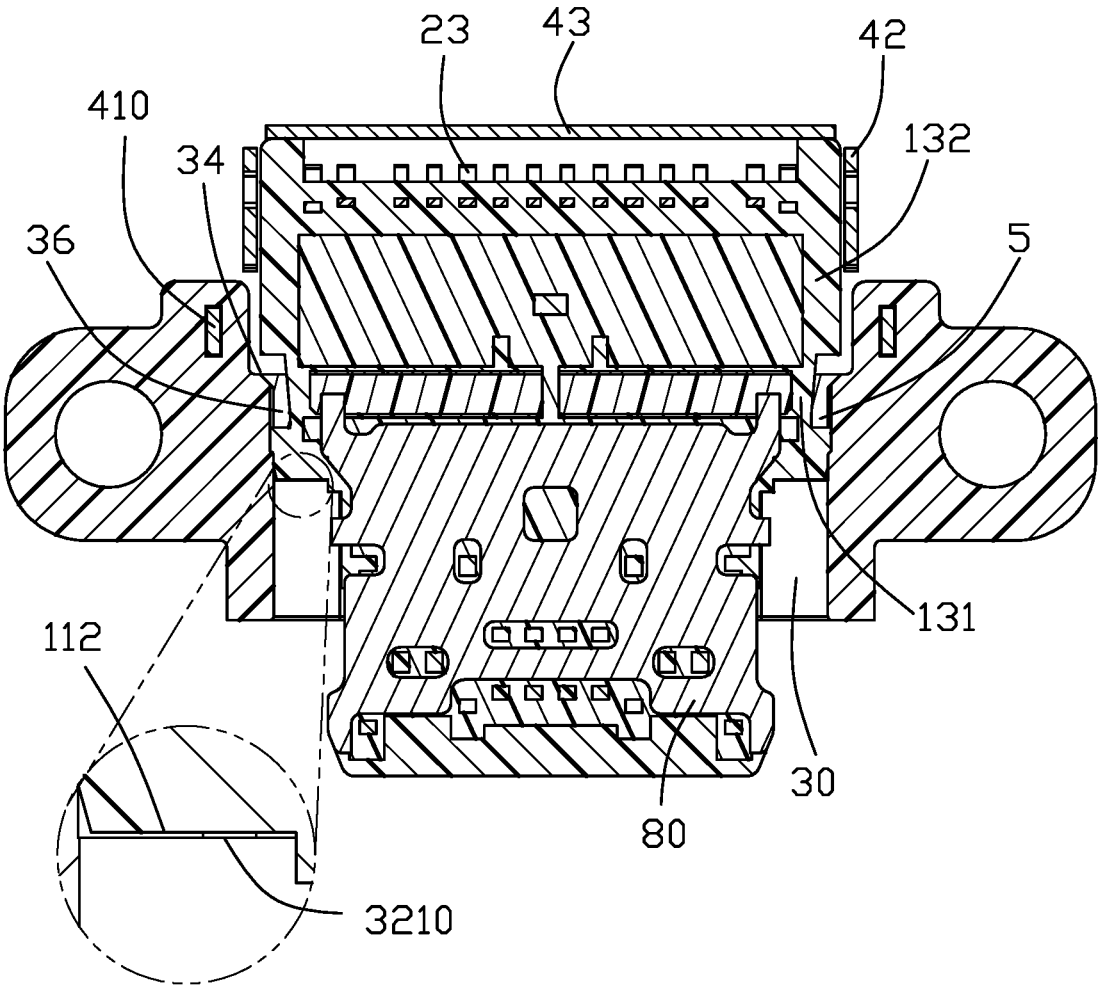
FIG. 8 is a cross-sectional view of the electrical connector taken along line B-B in FIG. 1.
Figure 9:
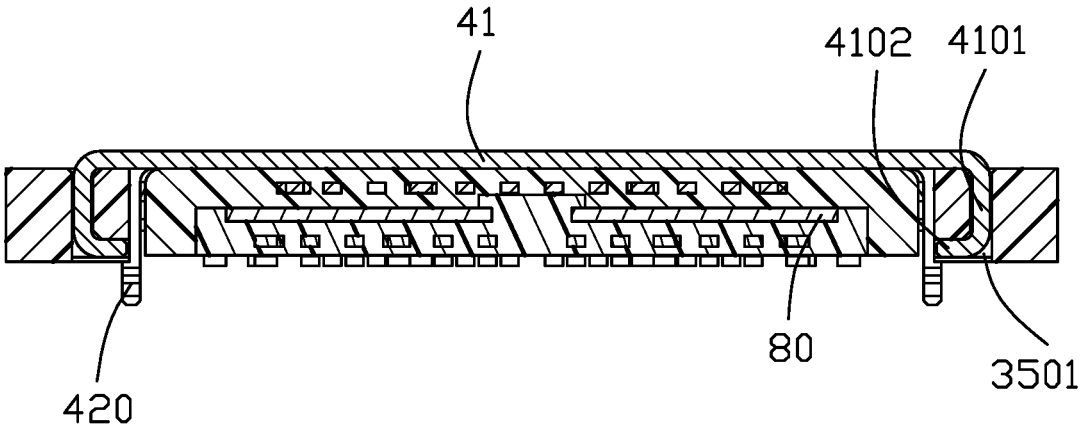
FIG. 9 is a cross-sectional view of the electrical connector taken along line C-C in FIG. 2.

A pair of restraining stops 33 are formed on the interior wall 31 of the insulative shell 3 to prevent a rearward movement of the base 11 once the latter is mounted to the insulative shell 3. Each restraining stop 33 has a guiding face 331. As shown in FIG. 7, corresponding to the rearward oblique guiding face 331, a forward oblique guiding face (not labeled) is formed on a front face of the base 11 so as to allow the housing 1 to be forwardly assembled into the insulative shell 3 by passing the restraining stop 33 and stopped by the stop wall 32. In other words, the base 11 is sandwiched between the stop wall 32 and the restraining stop 33 in the front-to-back direction.

The rear mount 13 extends rearward beyond a rear face 34 of the insulative shell 3. The metallic shell 4 has a top wall 41 covering a top of the rear mount 13, a pair of side walls 42 covering both sides of the rear mount 13, and a rear wall 43 covering a rear of the rear mount 13. Each side wall 42 has a soldering leg 420 and a hole 421. The rear mount 13 has a pair of protrusions 130 locked in the holes 421 so that the metallic shell 4 is fixed to the rear mount 13. The insulative shell 3 includes a pair of mounting lugs/ears 35 each having a hole 351. The mounting lug 35 includes a positioning portion 350 having a slot 3501. The metallic shell 4 has a pair of securing arms 410 fastened to the pair of mounting lugs 35. Specifically, the pair of securing arms 410 are bent from the top wall 41 and located in front of the pair of soldering legs 420; the slot 3501 is disposed inwardly and rearwardly of the hole 351 and further rearwardly of the rear face 34 of the insulative shell 3. The securing arm 410 has an upper portion 4101 inserted into the slot 3501 and a lower portion 4102 bent from the upper portion 4101 for locking the metallic shell 4 to the insulative shell 3.

The rear face 34 of the insulative shell 3 extends rearward beyond a rear face of the base 11 to form a filling chamber 36 therebetween. The rear mount 13 has a front part 131 in the filling chamber 36 and a rear part 132. The front part 131 has a reduced lateral dimension in order to obtain a better sealing effect during forming the sealing member 5 which is intimately attached on a rear face of the base 11 and cooperates with the base 11 to sandwich the corresponding restraining stop 33 therebetween in the front-to-back direction.

What is claimed is:

1. An electrical connector comprising:

a contact module including in a vertical direction an upper row contacts, a lower row contacts with a metallic shielding plate therebetween all integrally formed within an insulative housing via insert-molding, the housing including a base, a front tongue and a rear mount extending from the base opposite in a front-to-back direction perpendicular to the vertical direction;

an insulative shell having opposite top wall and bottom wall and opposite two side walls to commonly form a receiving space in which the base and the front tongue are both received; and a metallic shell secured to at least one of the insulative shell and the housing to cover the rear mount in the vertical direction while essentially located behind the insulative shell so as to expose the insulative shell in the vertical direction; wherein the insulative shell forms a stop wall on an interior surface thereof to abut against a front face of the base for stopping further forward movement of the housing, and a restraining stop to abut against a rear face of the base so as to sandwich the base therebetween in the front-to-back direction.

2. The electrical connector as claimed in claim 1, wherein a waterproof sealing member is located in the insulative shell and intimately attached behind the base while in front of the rear mount and the metallic shell.

3. The electrical connector as claimed in claim 1, wherein the base is fully enclosed within the insulative shell while only one half the front tongue is enclosed within the insulative shell.

4. The electrical connector as claimed in claim 1, wherein said stop wall forms an opening along the front-to-back direction, and the base forms a block received within the opening.

5. The electrical connector as claimed in claim 1, wherein the metallic shell further shields a rear face of the rear mount in the front-to-back direction.

6. The electrical connector as claimed in claim 1, wherein the metallic shell is secured to both the housing and the insulative shell.

7. The electrical connector as claimed in claim 1, wherein said insulative shell includes a pair of mounting ears, with corresponding through holes, on two lateral sides in a transverse direction perpendicular to both the vertical direction and the front-to-back direction, and the metallic shell is secured to the pair of mounting ears.

8. The electrical connector as claimed in claim 1, wherein the lower row contacts and the shielding plate are firstly integrally formed within a first insulator via a first stage insert-molding process to form a preliminary contact module, and the upper row contacts are successively assembled upon the preliminary contact module and integrally formed within a second insulator to form the contact module completely.

9. The electrical connector as claimed in claim 1, wherein said restraining stop is sandwiched between the base and a waterproof sealing member which is intimately attached behind the base in the front-to-back direction.

10. The electrical connector as claimed in claim 9, wherein the restraining stop forms a rearward oblique guiding face while the front face of the base forms a forward oblique guiding face so as to allow the housing to be forwardly assembled into the insulative shell from a rear side of the insulative housing.

11. An electrical connector comprising:

a housing having a base, a front tongue, and a rear mount;

an upper and lower rows of contacts arranged in the housing and exposed respectively to two opposite surfaces of the tongue;

an insulative shell mounted to the base and including a pair of mounting lugs, each mounting lug having a hole; and a metallic shell shielding the rear mount; wherein the metallic shell has a pair of securing arms fastened to the pair of mounting lugs; and the mounting lug has a slot disposed inwardly and rearwardly of the hole, and the securing arm has an upper portion inserted into the slot and a lower portion bent from the upper portion.

12. The electrical connector as claimed in claim 11, wherein the metallic shell has a pair of holes, and the rear mount has a pair of protrusions locked in the pair of holes.

13. An electrical connector comprising:

a housing having a base, a front tongue, and a rear mount;

an upper and lower rows of contacts arranged in the housing and exposed respectively to two opposite surfaces of the tongue;

an insulative shell mounted to the base and including a pair of mounting lugs, each mounting lug having a hole; and a metallic shell shielding the rear mount; wherein the metallic shell has a pair of securing arms fastened to the pair of mounting lugs; and the metallic shell has a pair of holes, and the rear mount has a pair of protrusions locked in the pair of holes.

* * * * *